US006422118B1

(12) United States Patent
Edwards

(10) Patent No.: US 6,422,118 B1
(45) Date of Patent: Jul. 23, 2002

(54) BRAIDED CORD SPLICE

(75) Inventor: Mark Stephen Edwards, Hockessin, DE (US)

(73) Assignee: E.I. du Pont de Nemours & Company, Wilmington, DE (US)

( * ) Notice: Subject to any disclaimer, the term of this patent is extended or adjusted under 35 U.S.C. 154(b) by 0 days.

(21) Appl. No.: 09/679,235

(22) Filed: Oct. 4, 2000

(51) Int. Cl.[7] ..... D04C 1/00
(52) U.S. Cl. ..... 87/13; 87/8; 28/141; 57/202
(58) Field of Search ..... 57/22, 202, 236, 57/237; 87/3, 8, 9, 10, 11, 12, 13; 28/141

(56) References Cited

U.S. PATENT DOCUMENTS

| | | | | | |
|---|---|---|---|---|---|
| 2,482,204 | A | * | 9/1949 | Peterson | 57/202 |
| 3,561,318 | A | | 2/1971 | Andriot | |
| 4,191,009 | A | * | 3/1980 | Thomson | 57/202 |
| 4,538,407 | A | * | 9/1985 | Matsui et al. | 57/22 |
| 5,765,352 | A | * | 6/1998 | McRae | 57/22 |
| 5,901,632 | A | * | 5/1999 | Ryan | 87/13 |
| 5,931,076 | A | * | 8/1999 | Ryan | 87/13 |

FOREIGN PATENT DOCUMENTS

| | | |
|---|---|---|
| GB | 1 266 493 | 3/1972 |
| WO | WO 00/05162 A2 | 2/2000 |

* cited by examiner

*Primary Examiner*—Danny Worrell
*Assistant Examiner*—Gary L. Welch

(57) ABSTRACT

The present invention relates to spliced, braided, cords having a nearly constant cross-section along the cord and at the location of the splice. The invention also relates to a splicing process.

13 Claims, 1 Drawing Sheet

BRAIDED CORD SPLICE

BACKGROUND OF THE INVENTION

1. Field of the Invention

This invention relates to braided cords joined by a splice wherein the splice is strong and nearly invisible.

2. Description of Related Art

International Publication No. WO 00/05162, published Feb. 3, 2000 discloses a tubular textile rope splice wherein the ends of tubular rope to be spliced are inserted into each other and the several plies of each rope are separated from the adjacent plies and pulled out of the braiding.

U.S. Pat. No. 5,901,632 and 5,931,076 issued May 11 and Aug. 3, 1999, respectively, disclose a "Chinese finger" splice for joining braided yarns.

BRIEF SUMMARY OF THE INVENTION

A process is provided for joining ends of cord of braided individual plies comprising the steps of: unbraiding individual plies of a portion of each of the ends to be joined, leaving a main braided body of cord; locating and connecting together corresponding plies from each of the ends; pulling the connected plies back through the main braided bodies of the cord, with each of the connected plies being pulled through at a different distance from the ends, until the main braided bodies of cord to be joined are in close proximity and excess connected plies are protruding from the cord; and removing the excess connected plies from the cord.

Also provided, is a spliced, braided, cord having opposing braided cord bodies with individual braided plies wherein the plies of one braided cord body extend, in the braiding, into an opposing braided cord body and are present as substitute for, and in the place of, individual plies that were a part of that opposing braided cord body before the splice. Generally, the spliced section has a diameter and cross section substantially the same as the diameter and cross section of the rest of the braided cord. Further, an endless braided cord is provided having the splice of this invention.

BRIEF DESCRIPTION OF THE DRAWING(S)

DETAILED DESCRIPTION OF THE INVENTION

Figure 1:
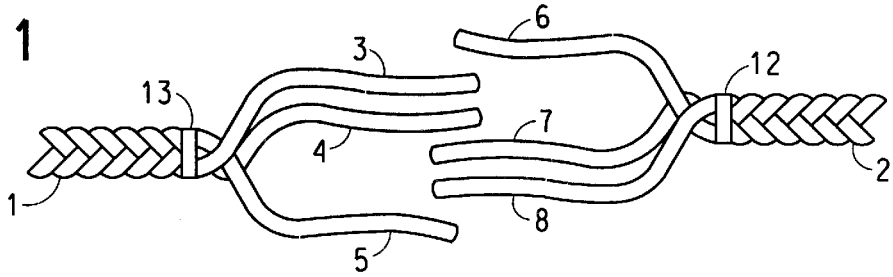
FIG. 1 depicts the unbraided plies of two simple cords to be joined in accordance with the instant invention.
Figure 2:
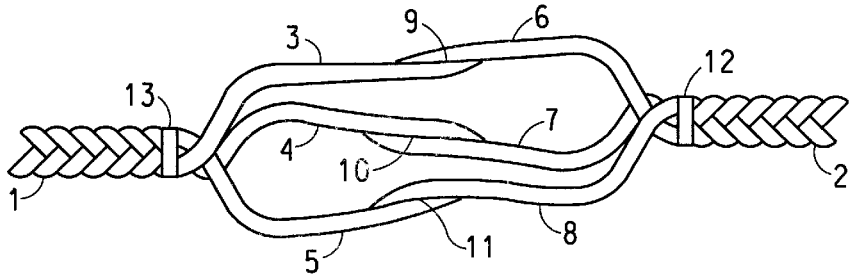
FIG. 2 depicts the same cords with corresponding unbraided plies connected.

Referring to the Figures, three-ply braided cords are depicted for the sake of simplicity. This invention is, of course, applicable to cords with any number of plies; and, can even be used to splice cords with different numbers of plies by connecting more than one ply from a cord with excess plies to single plies of a smaller cord. Included within the term "cord" are all braided structures variously known as ropes, strands, yarns, and the like. FIG. 1 shows braided cords 1 and 2 with individual unbraided plies (3, 4, 5 and 6, 7, 8) on each cord. FIG. 2 shows a step in the process of this invention wherein individual plies of each cord are located and connected together. It is important that the individual plies that are ultimately connected together correspond in a way that permits the cord ends to be joined without crossing individual plies at the cord end faces. In other words, as the cords to be joined are placed end-to-end, corresponding individual plies are also end-to-end. The individual plies can be connected in any way that will permit the connected plies to be pulled through the braided cord structure. For example, knotting corresponding plies might result in a connection that is so large that it cannot be pulled through the cord braiding. On the other hand, the ends of the individual plies can be tapered, as shown at ply connections 9, 10, and 11, and glued or otherwise adhered together without undue enlargement of the ply. Such tapered plies could be connected together with string or tape or the individual filaments of the plies could be intertangled using needle-punching or air jets, or any combination of connecting means. While tapering the plies might be useful or helpful, it is not always necessary for successful practice of this invention.

Figure 3:
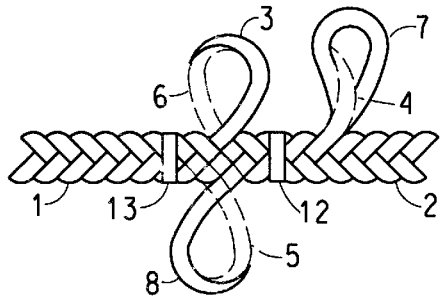
FIG. 3 depicts one pair of the connected plies as it is pulled back through one of the cords.
Figure 4:
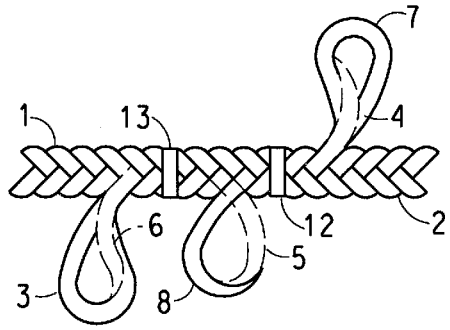
FIG. 4 depicts the same cords with a second pair of the connected plies pulled back through the other of the cords.
Figure 5:
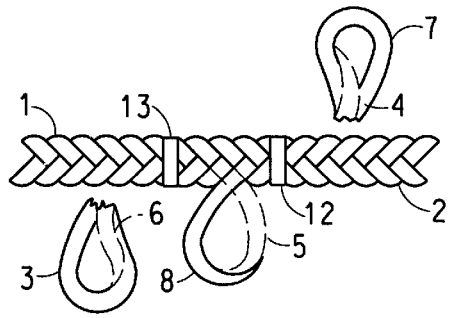
FIG. 5 depicts the individual plies having been drawn into different positions in the opposing braided cord body and the subsequent removal of excess connected plies.

When corresponding individual plies have been located and connected, the connected plies can be pulled back through the main braided body of one of the cords being joined to draw the cords together. Care must be taken to assure that the several connected plies are each pulled back through a braided portion of the cord that is a different length than the braided portion through which other connected plies are pulled. Connected plies are pulled back by tracing one of the plies back into the main braided body of one of the cords to be joined and separating that ply from the body of the cord and pulling it to draw the connected ply into and through the braided main body of the cord and continuing to pull the ply until the main braided bodies of the cords to be joined are in close proximity and all of the excess connected plies are protruding from the cord. Referring to FIG. 3, ply 7 was traced back into cord 2 and was pulled through the braiding of cord 2 to draw connected plies 4,7 into and through cord 2 until the main braided bodies of cord 1 and cord 2 were in close proximity. In FIG. 3, connected plies 5,8 and 3,6 have yet to be drawn through a cord. FIG. 4 shows the joining of cords 1 and 2 to be complete with connected plies 5,8 drawn through cord 1. When all, or all but one, of the connected plies have been drawn back through the braided cords, the excess connected plies are removed and the splice is complete. Removal of the excess connected plies can be accomplished by any ply-cutting means. It should be noted that the last of the several plies need not be pulled back through the cord. The last of the several plies can be merely cut off to remove the excess.

To facilitate the splicing operation, a thin band of tape, wire tie, or string can be lightly fastened to each cord at locations 12 and 13 to prevent further unbraiding or disturbance to the braided main body of cords 1 and 2 in the course of the splicing.

When the cord to be spliced contains more than three plies, the braided cord will often have the appearance of a tube. When splicing braided cords with tube-like characteristics, it is often advantageous to insert the first half of a small rod into the braided end of cord 1 and then slide cord 2 over the other half of the rod until the two braided ends are in close proximity. The rod diameter can be chosen sufficient to easily pass through the braided "tube" yet not slide out or reposition itself easily. The length of the rod can be approximately equal to twice the length of an unbraided ply. The rod holds the two cords in position and helps to prevent entanglement of the individual plies. The rod can be removed when the splice is completed by pushing one end of the rod through the braided plies and then pulling it free from the spliced cord.

In drawing connected plies back through the main braided body of the cords to be joined, the individual plies from one cord are made to replace individual plies from another cord and the replacement plies are held by the braiding to maintain very high strength in the joined cords. More strength is maintained if the plies are drawn to lengths of greater differences into the cord. It is estimated that the plies should be drawn to differences of 3 to 16 or as many as 20 courses of braiding and that drawing to differences of 6 to 10 courses of braiding is preferred.

Because the aim is generally to provide a smooth splice with no irregularity in the cord cross-section through the length of the splice, care should be exercised to make the unbraided individual plies at least long enough that only the ply and not the ply connection is, after pulling the ply, finally located in the joined cord. To assure such a result, the plies must be pulled back through the cord to be joined from a location that is less distance from the main braided body of the cord than the length of the unbraided individual plies. If it is desired or required for any reason, a splice of this invention can, also, be made wherein the ply connection, after pulling the ply, remains in the cord to be joined.

As a general matter, it is thought advantageous to pull the connected plies back into the main braided body of all of the cords to be joined rather than pulling them into only one of the cords. As a matter of balance, it is thought best to pull the connected plies in approximately equal numbers into the cords to be joined. For example, in joining two cords of ten plies, it is thought best that five of the plies be pulled into each of the cords—or four into one cord and six into the other, so that the maximum distance can be maintained between adjacent, individual, plies. It is, nevertheless, the case, though not preferred, that a splice of this invention can be made wherein all of the connected plies are pulled back through the main braided body of only one of the cords.

Pulling the connected plies back through the braided cords causes an unavoidable disruption in the texture of the cord at the ply cuts, even after the excess connected plies have been removed. To smooth the disruption and alleviate any tendency for the plies to fray, the cut ends of the plies can be sealed with a small amount of adhesive or sizing.

This invention finds particular use in ropes, cables, and endless belts using braided cords wherein splices are necessary and irregular cord diameters are unacceptable. This invention provides a spliced cord wherein the opposing braided cord bodies are the two ends of the same cord and the spliced cord is an endless loop of uniform diameter. This invention is particularly useful for cords of high performance materials such as para-aramids, meta-aramids, high molecular weight linear polyolefins, polyethylene terephthalate, nylon, and the like.

The most common use for this invention is in joining the ends of one or two braided cords; but more than two cords can, also, be joined by this process.

What is claimed is:

1. A process for joining ends of cord of braided individual plies comprising the steps of:

(a) unbraiding individual plies of a portion of each of the ends to be joined, leaving main braided bodies of cord;

(b) locating and connecting together corresponding plies from each of the ends;

(c) pulling the connected plies back through the main braided bodies of cord, with each of the connected plies being pulled through at a different distance from the ends until the main braided bodies of cord to be joined are in close proximity and excess connected plies are protruding from the cord;

(d) removing the excess connected plies from the cord.

2. The process of claim 1 wherein there are two ends of cord to be joined.

3. The process of claim 1 wherein the connected plies are pulled, in about equal numbers, back through each of the cords to be joined.

4. The process of claim 1 wherein the connected plies are pulled back through the main braided body of only one of the cords.

5. The process of claim 1 wherein the connected plies are pulled back through the main braided body of the cord to be joined from a location that is less distance from the end of the cord than the length of the unbraided individual plies of step (a).

6. A spliced, braided, cord comprising: opposing braided cord bodies with individual braided plies wherein the plies of one braided cord body extend, in the braiding, into an opposing braided cord body and are present as substitute for, and in the place of, individual plies that were a part of that opposing braided cord body before the splice wherein there is no irregularity in cord cross-section through the length of the splice.

7. The spliced cord of claim 6 wherein there are two opposing braided cord bodies.

8. The spliced cord of claim 6 wherein individual plies from each of the opposing braided cord bodies are present in about equal numbers in all of the braided cord bodies.

9. The spliced cord of claim 6 wherein each individual ply substituted for the ply in another braided cord portion is a different length.

10. The spliced cord of claim 6 wherein the opposing braided cord bodies are the two ends of the same cord and the spliced cord is an endless loop.

11. The spliced cord of claim 6 wherein there is no irregularity in cord crosssection through the length of the splice.

12. A spliced, braided, cord comprising: opposing braided cord bodies with individual braided plies wherein the plies of one braided cord body extend, in the braiding, into an opposing braided cord body and are present as substitute for, and in the place of, individual plies that were a part of that opposing braided cord body before the splice wherein individual plies from each of the opposing braided cord bodies are present in about equal numbers in all of the braided cord bodies.

13. A spliced, braided, cord comprising: opposing braided cord bodies with individual braided plies wherein the plies of one braided cord body extend, in the braiding, into an opposing braided cord body and are present as substitute for, and in the place of, individual plies that were a part of that opposing braided cord body before the splice wherein each individual ply substituted for the ply in another braided cord portion is a different length.

* * * * *